United States Patent [19]

Mathes et al.

[11] 4,369,156

[45] Jan. 18, 1983

[54] PROCESS FOR THE PREPARATION OF FIBRILLATED FIBER STRUCTURES

[75] Inventors: Nikolaus Mathes, Breuberg; Friedbert Wechs, Wörth am Main, both of Fed. Rep. of Germany

[73] Assignee: Akzona Incorporated, Asheville, N.C.

[21] Appl. No.: 124,256

[22] Filed: Feb. 25, 1980

[30] Foreign Application Priority Data

Feb. 27, 1979 [DE] Fed. Rep. of Germany ..... 2907623

[51] Int. Cl.[3] ..... B29H 7/18

[52] U.S. Cl. ..... 264/147; 264/171

[58] Field of Search ..... 264/147, 171, 343, 182; 8/130.1

[56] References Cited

U.S. PATENT DOCUMENTS

| | | | |
|---|---|---|---|
| 2,558,730 | 7/1951 | Cresswell | 264/182 |
| 3,053,609 | 9/1962 | Miller | 8/130.1 |
| 3,060,550 | 10/1962 | Smith | 28/76 |
| 3,228,745 | 1/1966 | Galatioto | 264/343 |
| 3,350,488 | 10/1967 | Breen | 264/171 |
| 3,645,668 | 2/1972 | Nigoshi et al. | 8/130.1 |
| 3,853,977 | 12/1974 | Matsui et al. | 264/147 |
| 3,917,784 | 11/1975 | Nishida | 264/147 |
| 3,966,865 | 6/1976 | Nishida et al. | 264/171 |
| 4,051,287 | 9/1977 | Hayashi et al. | 264/171 |
| 4,165,556 | 8/1979 | Nishida et al. | 264/147 |
| 4,239,720 | 12/1980 | Gerlach et al. | 264/147 |

FOREIGN PATENT DOCUMENTS

| | | | |
|---|---|---|---|
| 49-45727 | 12/1974 | Japan | 264/147 |
| 51-58578 | 5/1976 | Japan | 428/398 |
| 51-92311 | 8/1976 | Japan | 264/171 |
| 52-30629 | 8/1977 | Japan | 428/373 |

*Primary Examiner*—Jay H. Woo

*Attorney, Agent, or Firm*—Francis W. Young; Jack H. Hall

[57] ABSTRACT

Fiber structures such as staple fibers, filaments, yarns as well as textile sheet structures such as woven or knitted fabrics as well as non-woven fabrics and the like made from multicomponent fibers of the matrix-segment type having in their cross sections a plurality of segments arranged peripherally without being fully surrounded by the matrix and being composed of polyalkylene terephthalate and copolyamides based on ε-caprolactam and hexamethylene diamine/adipic acid salt, are split by treatment with liquid or vaporous water. The difference in shrinkage between copolyamide and polyalkylene terephthalate in water is temporarily at least 10%. Corresponding short-staple fibers are particularly well suited for making wet-laid non-woven fabrics. The water used for treatment of the fiber structures may contain inorganic salts.

15 Claims, 6 Drawing Figures

PROCESS FOR THE PREPARATION OF FIBRILLATED FIBER STRUCTURES

Figure 1:
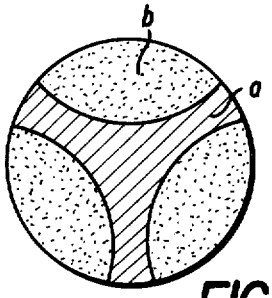

The invention relates to a process for the production of fibrillated fiber structures by splitting multicomponent fibers consisting of polyamide and polyester by subjecting them to the action of aqueous treatment media.

In the past, a series of processes aiming at the splitting of multicomponent filaments by subjecting them to the action of an aqueous medium have been described.

In U.S. Pat. No. 3,117,906, a process is described whereby the multicomponent filaments whose components are aligned side-by-side are treated with hot water. However, to achieve splitting of the multicomponent filaments into individual components, it is necessary once the filaments have been processed to e.g., a woven fabric to subject them to a flexing treatment. It is furthermore necessary to load the treatment medium with additives such as soaps, detergents and swelling agents. A complete splitting of the multicomponent fibers into individual fibers cannot always be reliably achieved according to the method described therein; moreover, the process is involved and labor-intensive.

U.S. Pat. No. 3,966,865 describes a process for the production of fibrillated fiber structures whereby the multicomponent fibers are split by means of an aqueous emulsion, which in addition to benzyl alcohol and/or phenylethyl alcohol should also contain surfactants.

One drawback of this process is that relatively high concentrations, preferably to 20%, of the alcohol must be used, that in addition to the alcohol the presence of a surfactant is necessary and moreover that the transmission of the treatment medium for light of wavelength 495 nm must always be precisely controlled. Due to the presence of the cited chemicals, the process is not especially ecologically safe and processing of effluents is fraught with difficulties. Moreover, the process is expensive, complex, time-consuming and because of the long detention times not especially suited for a continuous operation; also, it fails at temperatures above 80° C. The resulting products are often rough, have a harsh hand and lead to structures lacking softness and drape.

Like U.S. Pat. No. 3,966,865, U.S. Pat. No. 4,073,988, col. 11 (Notes to Table I), states that the fiber structures of multicomponent fibers can be separated and the fabric made therefrom shrunk by a treatment with an aqueous emulsion of benzyl alcohol. Woven or knitted fabrics of these yarns exhibit, after dyeing, a high degree of streakiness because of the moderate uneven fibrillation.

Hence, there is still a need for an improved, simple process for the production of fibrillated fiber structures by splitting multicomponent fibers which would result in products having favorable characteristics.

An object of the invention is therefore to make available a process suitable for industrial application and leading to fully fibrillated fiber structures without requiring additional mechanical aftertreatments. Another object of the invention is to offer a process leading to fibrillated structures by treatment with water without having to add a number of chemicals to the water so that, in carrying out the process, operators are not exposed to health hazards and the environment to pollution, and the treatment of effluents, if necessary at all, is relatively straightforward.

A further object of the invention is to make available a process for obtaining soft, low denier structures having a silky hand, which process can be carried out, without great difficulty or expense, in conventional equipment, i.e., washing machines, dyeing apparatus, tanks, etc.

These objects are met with a process for the preparation of fibrillated fiber structures by splitting multicomponent fibers of polyamide and polyester by treatment solely with water, in liquid or vaporous form, characterized by fiber structures such as staple fiber, filaments, yarns, sheet structures and the like of multicomponent fibers consisting of polyalkylene terephthalate and copolyamides based on ε-caprolactam and hexamethylene diamine/adipamide (adipic acid salt), having over the cross section a matrix and multi-segment arrangement whereby the segments represent a fraction of about 20–80% and at least 3 segments are aligned peripherally without being completely embedded in the matrix component, and whereby the peripheral segments have, at least temporarily, a shrinkage difference of at least 10% compared to the matrix when said fiber structures are subjected to treatment with water in liquid or vapor form.

Use is preferably made of copolyamides based on 80 to 90%-caprolactam. Copolyamides based on 10 to 30% ε-caprolactam are also eminently suited. The fiber structures can be subjected to a preliminary setting. The peripheral segments are expediently completely separated from one another by the matrix component. A preferred arrangement has at least 6 segments in the periphery of the cross section. Cross sections with at least 12 peripheral segments are also advantageous. Preferably at least 20% of the circumference of the peripheral segments is not embedded in the matrix, and it is particularly advantageous when about 50%, or less, of the circumference of the peripheral segments is encompassed by the matrix component.

The portion of the circumference of the peripheral segment encompassed by the matrix component may assume a convex, essentially circular shape.

In an especially suitable version of the process of the invention, use is made of multicomponent fibers with peripheral segments of a polyalkylene terephthalate, preferably polyethylene terephthalate.

The water with which the fiber structures are treated may contain small quantities, up to 5% and preferably from 1 to 3%, of dissolved inorganic salts, calcium chloride being eminently suitable.

During the water treatment of the multicomponent fibers, it may be advantageous to include an additional mechanical treatment, and treatment of the multicomponent fiber with ultrasound is particularly suitable for this purpose. Agitating the fiber structures during treatment with water may also be advantageous.

An especially favorable fibrillation is obtained when the fiber structures of the invention are composed of crimped multicomponent fibers. In a special version of the process of the invention, the fiber structures consist of short, cut fibers of about 3–8 mm length.

These short cut fibers are used especially for the production of wet-laid webs.

The multicomponent fibers can be crimped by a stuffer box crimping process, but other conventional texturing methods may also be used.

Multicomponent fibers of copolyamides and polyalkylene terephthalates can be obtained by different methods, for example by melt-spinning multicomponent fibers in conjunction with suitable spinnerets and spinning devices and using the required polymers, followed by conventional drawing to impart at least temporarily a sufficient shrinkage differential, i.e., of at least 10%, between matrix component and peripheral segments during treatment with water.

FIGS. 1 through 6 illustrate the cross-sectional structure of the filaments which are suitable for carrying out the process of this invention. In each of the figures, a represents the matrix and b indicates the segments.

These multicomponent fibers are very advantageously obtained by a process and device described in copending U.S. patent application Ser. No. 6,491 filed Jan. 25, 1979.

Figure 2:
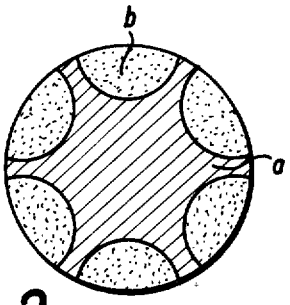
Figure 6:
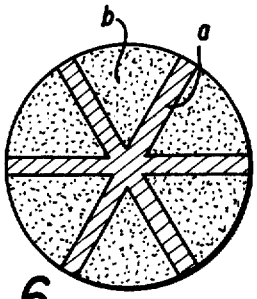

Multicomponent fibers of cross sections as shown in FIGS. 1, 2 and 6 are particularly easily fibrillated by the method of the present invention. The number of peripheral segments need not necessarily be 3 or 6; there may be 12 peripheral segments or even 7 or 9 peripheral segments. According to the invention, the segments may consist of copolyamide and the matrix of polyalkylene terephthalate; however, the segments could without problem consist of polyalkylene terephthalate with copolyamide used for the matrix.

Particularly suitable polyalkylene terephthalates are polyethylene terephthalate and polybutylene terephthalate.

Figure 3:
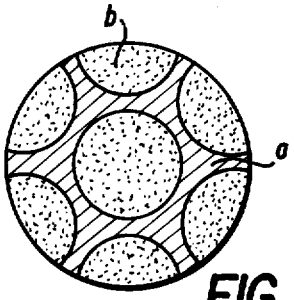
Figure 4:
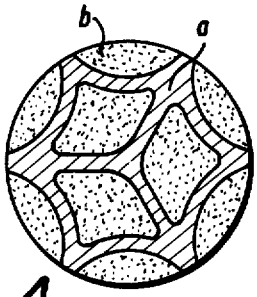
Figure 5:
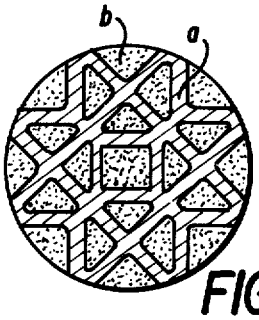

Multicomponent filaments having the cross section shapes illustrated in FIGS. 3, 4 and 5 are also suitable within the framework of the invention. However, the peripheral segments are preferably of copolyamide. These cross sections are less well suited for multicomponent fibers whose matrix is composed of copolyamides. The central segment which in the case of a copolyamide matrix is generally composed of polyester may adversely affect the shrinkage of the matrix so that full fibrillation is not readily accomplished.

The multicomponent filament need not necessarily have an overall circular profile; other shapes, e.g., elliptical, triangular, trilobal or other conventional cross section profiles are also possible.

Copolyamides as used for the invention have been known for quite some time and can be prepared according to processes conventionally used for the preparation of heteropolyamides.

To accomplish splitting of the multicomponent fibers into matrix fibers and segment fibers the temperature of the water used to treat the fiber structures should be at least 5° C. below the melting or softening point of the employed copolyamide in the presence of water, since otherwise the heteropolyamide softens or melts and no coherent copolyamide fibers can split off. The temperature of the water is preferably at least 10°to 20° C. below the softening point of the copolyamide. A higher water temperature may lead to sticking, which may under certain conditions be desirable, e.g., when after complete splitting consolidation of a fiber structure e.g., a web is sought. To determine the softening point, a 70 cm long hank of the copolyamide is immersed for a least 1 minute in water at a specific temperature, followed by evaluation of its behavior while still wet. When the shrinkage exceeds about 50%, or the filament is rubber-like, or has formed a mass, the softening point has been reached.

The best treatment conditions for the process of the invention and the temperature of onset of softening are listed in the following table as a function of the copolyamide composition.

TABLE

| Composition ε-caprolactam | Favorable Treatment Temperature | Onset of Softening in Presence of Water at |
|---|---|---|
| 90 | ca. 120–130° C. | ca. 135–140° C. |
| 85 | ca. 100–105° C. | ca. 115–120° C. |
| 80 | ca. 85– 90° C. | ca. 95–105° C. |
| 60 | ca. 55– 60° C. | ca. 65– 75° C. |
| 30 | ca. 85– 90° C. | ca. 100–110° C. |
| 15 | ca. 120–130° C. | ca. 135–145° C. |

These favorable treatment temperatures relate to flat knit material of flat filament yarn. A virtually complete splitting can be obtained even below these treatment temperatures under special conditions, e.g., when the fiber length is very small (about 5 mm) or when the aqueous treatment is simultaneously enhanced by mechanical treatment (beating of the short cut fiber in the production of wet-laid webs), or when a special copolyamide of 60 parts caprolactam and 40 parts nylon salt is used. With a combination of these extremely favorable conditions, complete splitting can be achieved within 1 to 2 days with exposure only to moist air at room temperature.

Individual components, i.e., polyethylene terephthalate or the heteropolyamide may each or both together contain liquid, solid or gaseous additives like pigments, carbon black, stabilizers, antistats, silicone oils, nitrogen, etc. Prior to treatment in water, a finish can be applied to the filaments. In certain cases this will accelerate and/or improve the splitting of the multicomponent fibers into matrix and segment filaments.

Before splitting, the filaments can be processed in otherwise known manner to fiber structures such as staple fibers, filaments, yarns, sheet structures, and the like. For processing to cited fiber structures, the multicomponent fibers are preferably still essentially unsplit; however, a slight, moderate splitting is acceptable to the extent that it does not adversely affect processing.

Prior to treatment with water, the fibers can be subjected to a preliminary setting treatment, whereby the fibers are stabilized. Said treatment can be carried out e.g. in relatively dry air at 150° C. During said presetting, the shrinkage of the polyester can be reduced down to nearly 0%. It is, however, important that treatment not affect the shrinkage of the polyamide to the point that there is no longer a shrinkage differential with respect to polyester during treatment with water. Therefore, during preliminary setting, exposure to moisture should be avoided as much as possible.

The water used to treat the fiber structures may contain small quantities, e.g., from 0 to about 5% and preferably as least about 3%, of inorganic salts, e.g., magnesium chloride, lithium fluoride. Calcium chloride is eminently suitable small amount of alkali, e.g. have about 0 to 5% and preferably at least 2% can also be added to the water, e.g. NaOH.

Small amounts of wetting agents, e.g., from about 0 to about 5% and preferably at least about 4%, can also be added to the water, e.g., soaps or conventional cationic, anionic, amphoteric or non-ionogenic surfactants, e.g., Lensodel, a Shell product, available on the market on the date of the application.

When the treatment with water can on the basis of the composition of the copolyamide be carried out at temperatures between 120° and 130° C., which is possible with copolyamides based on 90% or more or 15% or less-caprolactam, the splitting operation can be combined with high temperature (HT) dyeing.

It is often advantageous to combine the treatment of the fiber structure with water with an additional mechanical treatment. This additional mechanical treatment of such fiber structures as staple fiber, filaments, yarns or sheet structures, can be performed by agitating the stock in the treatment bath, for example by stirring, by regular or irregular lifting and lowering; it is also possible to provide this additional treatment for example by compression and relaxation or by milling.

Especially suitable is a process whereby during water treatment the fiber structure is exposed to ultrasound. This can be accomplished by carrying out treatment with water in vessels normally used for ultrasound cleaning. Equipment of this type is commercially available and is listed in Bulletin CP-100 BE-1-72 of Bransoe Europe N.V. This equipment generally consists of a tank for the treatment of the material with liquids and is provided with an ultrasound generator installed in the frame. Other information on ultrasound and equipment operating with ultrasound is contained e.g., in Roempp-Chemie-Lexicon, Franksche Verlagshandlung, Stuttgart, 7th Edition, pp. 3726 to 3728 and in a paper by R. Sievers in "Maschinenanlagen, Verfahren," Vol. 7 to 8/73-Metall-reinigung mit Ultraschall (Cleaning Metal with ultrasound). Treatment with ultrasound can be combined with one of the above-cited mechanical treatments, e.g., agitation.

It was very surprising to find that the process of the invention would result in a complete splitting into matrix and segment fibers. The products obtained by this process have a silk-like characteristic and a very soft hand as compared to hard, paper-like structures produced by known processes involving aqueous systems.

The process is extremely simple and can be carried out with conventional equipment. The process of the invention supplies fiber structures of extremely fine denier. Treatment time is relatively short so that mechanical properties of the filaments are not diminished.

The process is pollution free since addition of organic solvents and other substances creating problems in effluent processing is not needed.

The invention is explained in detail in the following examples:

EXAMPLE 1

Making use of a spinneret as described in copending U.S. patent application Ser. No. 6,491 a matrix/segment filament according to FIG. 2 of said application (and identical to FIG. 2 herein), having a denier of dtex 50 f 5 is spun from polyethylene terephthalate (rel. viscosity 1.63) and a copolyamide based on 85 parts ε-caprolactam and 15 parts hexamethylene diamine/adipamide (adipic acid salt) (rel. viscosity 2.20) in a weight ratio of 75 parts to 25 parts.

The spinning draw-off is 1200 mpm; the draw ratio is 1:3.26. The resulting yarn is made into a flat knit material. For fibrillation, the sample is subjected to standard washing at the boil in a household washing machine (Type Bosch VT 595, 95° C. for washing at the boil, selector set at 1, detergent=Proxidan).

After the wash cycle is completed, the sample is dried. A completely fibrillated knit material of soft, bulky hand, having a high covering power and silky appearance is obtained. As revealed by the microscope, the polyester segments are selectively located at the surface, whereas the copolyamide component is pulled by shrinkage to the inside of the knit material.

EXAMPLE 2

Unsplit yarn as per Example 1, but obtained from a copolyamide based on 10 parts ε-caprolactam and 90 parts hexamethylene diamine/adipamide is made into a flat knit fabric. for fibrillation, some 10 g of the specimen are treated for 30 minutes at 125° C. in a lab HT dyeing apparatus (Linitext HT Lab dyeing apparatus of Original Hanau Co.). The treatment medium is water containing 5% of the wetting agent Lensodel AB6. After cooling, the specimen is removed from the beaker, thoroughly rinsed and dried. The fully fibrillated knit sample exhibits a high covering power, a soft bulky hand and silk-like luster.

EXAMPLE 3

A matrix/segment filament is made up as described in Example 1 from a copolyamide of 15 parts ε-caprolactam and 85 parts hexamethylene diamine/adipamide and processed to a flat knit. This sample is subjected to a HT dyeing treatment in the lab testing apparatus mentioned in Example 2. After dyeing, the knitted sample is washed and dried. The polyester component is dyed by the treatment, which also fibrillates the sample and produces the characteristics described in Examples 1 and 2.

EXAMPLE 4

A matrix/segment filament prepared as per Example 1, but comprising a copolyamide of 60 parts ε-caprolactam and 40 parts hexamethylene diamine/adipamide is cut into short staple lengths of 5 mm. After cutting of the moist fiber tow, it can be observed that the 5 mm. long compact fiber bundles when allowed to stand in the presence of air (temperature about 22° C., RH about 65) become bulky and loose. Under the microscope at a magnification of 100 dia. the fibrillation process can be observed directly. It can be clearly seen at the cut ends that the copolyamide matrix shrinks and the polyester segments split off. Splitting is completed after about 1 day.

EXAMPLE 5

5 g. of freshly cut short staple according to Example 4 (i.e., with hardly any fibrillation) is vigorously agitated in a beaker in about 5 l. water at 60° C. with a stirring rod for about 1 minute. This results in complete fibrillation as can be seen under the microscope.

A wet-laid web is formed with this fiber suspension on a sheet forming apparatus (Ernst Hooker Co., Muelheim/Ruhr). Excess water is removed with filter paper from the fiber sheet which is then dried with IR radiation. This causes the homogeneously distributed copolyamide matrix to melt. A bonded, bulky and soft fiber web of high covering power and excellent absorbency is obtained after cooling.

We claim:

1. A process for the preparation of fibrillated fiber structures by splitting polyamide and polyester multicomponent drawn fibers by treatment with an aqueous medium, characterized by fiberstructures, such as staple fiber, filaments, yarns, sheet structures, etc. of multicomponent fibers consisting of polyalkylene terephthalate and copolyamides based on ε-caprolactam and hexamethylene diamine/adipamide, having over the cross section a matrix and multi-segment arrangement, whereby the segments represent a fraction of about 20–80% and at least 3 segments are aligned peripherally without being fully embedded into the matrix component, and whereby the peripheral segments and matrix have a shrinkage difference of at least 10%, and subjecting said fiber structures to an aqueous treatment consisting essentially of water in liquid or vapor form at a temperature of from about 55° C. to about 130° C., up to 5% of a water-soluble inorganic salt, from 0 to 5% of an alhoei and from 0 to 5% of a wetting agent.

2. The process of claim 1 wherein said copolyamide contains from 80% to about 90% ε-caprolactam.

3. The process of claim 1 wherein said copolyamide contains from 10 to about 30% ε-caprolactam.

4. The process of claim 1 wherein said water contains from about 1 to about 3% of said soluble inorganic salts, said salts being selected from the group consisting of calcium chloride, magnesium chloride and lithium fluoride.

5. The process of claims 1 or 4 wherein said fiber structures are set by contacting with substantially dry air at 150° C. prior to said water treatment.

6. The process of claims 1, 2, 3 or 4 wherein the peripheral segments are totally separated from each other by the matrix component.

7. The process of claim 6 wherein from about 20% to about 50% of the circumference of the peripheral segments is not encompassed by the matrix.

8. The process of claim 7 wherein the peripheral segments of said multicomponent fibers are polyalkylene terephthalate.

9. The process of claim 8 wherein the peripheral segments of said multicomponent fibers are polyethylene terephthalate.

10. The process of claim 8 wherein the peripheral segments of said multicomponent fibers are polybutylene terephthalate.

11. The process of claim 4 wherein said inorganic salt is calcium chloride.

12. The process of claims 1, 2, 3 or 4, wherein said fiber structures are crimped.

13. The process according to claims 1, 2, 3 or 4, wherein said fiber structures are short cut fibers having a length of about 3–8 mm.

14. The process of claim 1 wherein at least one segment is centrally located in the matrix and completely surrounded by said matrix.

15. The process of claim 14 wherein said polyalkylene terephthalate comprises said matrix and said copolyamide comprises said segments.

* * * * *